US012227277B2

(12) United States Patent
Tateishi

(10) Patent No.: US 12,227,277 B2
(45) Date of Patent: Feb. 18, 2025

(54) MARINE PROPULSION DEVICE, PROPELLER UNIT, AND METHOD

(71) Applicant: YAMAHA HATSUDOKI KABUSHIKI KAISHA, Iwata (JP)

(72) Inventor: Isao Tateishi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 17/955,598

(22) Filed: Sep. 29, 2022

(65) Prior Publication Data

US 2023/0109555 A1 Apr. 6, 2023

(30) Foreign Application Priority Data

Oct. 4, 2021 (JP) ..... 2021-163566

(51) Int. Cl.
*B63H 1/15* (2006.01)
*B63H 23/34* (2006.01)

(52) U.S. Cl.
CPC ..... *B63H 1/15* (2013.01); *B63H 23/34* (2013.01)

(58) Field of Classification Search
CPC ..... B63H 20/14; B63H 1/15; B63H 23/24; B63H 23/342; B63H 23/344
See application file for complete search history.

(56) References Cited

U.S. PATENT DOCUMENTS 6,027,424 A * 2/2000 Reynolds ..... F16H 3/54 475/269
6,609,892 B1 * 8/2003 Kreul ..... B63H 1/20 416/134 R
6,652,334 B1 * 11/2003 Kusche ..... F02B 61/045 440/52
10,336,419 B1 * 7/2019 Guse ..... B63H 20/22
2007/0053777 A1 * 3/2007 Harada ..... B63H 23/34 440/52
2008/0153367 A1 * 6/2008 Zhu ..... F16C 3/02 440/83
2011/0212657 A1 * 9/2011 Tsunekawa ..... B63H 23/34 440/49
2014/0023503 A1 * 1/2014 Nakamura ..... B63H 21/34 416/135
2014/0205455 A1 * 7/2014 Kuroki ..... B63H 1/20 464/89
2015/0336647 A1 * 11/2015 Ariga ..... B63H 1/14 416/146 R
2019/0270501 A1 * 9/2019 Onoue ..... B63H 20/14

FOREIGN PATENT DOCUMENTS

JP 2011-178228 A 9/2011

* cited by examiner

*Primary Examiner* — Courtney D Heinle
*Assistant Examiner* — Ryan C Clark
(74) *Attorney, Agent, or Firm* — Keating & Bennett, LLP

(57) ABSTRACT

A marine propulsion device includes a propeller, a propeller shaft, a bushing, a damper, and a spacer. The propeller shaft supports the propeller. The bushing is between the propeller and the propeller shaft and is unitarily rotatable with the propeller shaft. The damper is fixed to the bushing to transmit rotation of the propeller shaft to the propeller. The spacer is spaced apart from the propeller in a back-and-forth direction in front of the bushing to position the bushing in place with respect to the propeller shaft.

14 Claims, 9 Drawing Sheets

MARINE PROPULSION DEVICE, PROPELLER UNIT, AND METHOD

CROSS REFERENCE TO RELATED APPLICATIONS

This application claims the benefit of priority to Japanese Patent Application No. 2021-163566 filed on Oct. 4, 2021. The entire contents of this application are hereby incorporated herein by reference.

BACKGROUND OF THE INVENTION

1. Field of the Invention

The present invention relates to a marine propulsion device, a propeller unit, and a method.

2. Description of the Related Art

There has been known a type of marine propulsion device in which a torque outputted from an engine is transmitted to a propeller shaft and is then transmitted therefrom to a propeller through a damper. The damper absorbs a torque acting in a rotational direction of the propeller. Absorption of the torque acting in the rotational direction of the propeller by the damper inhibits noises produced by repetitive collisions between gears in a dog clutch due to torque fluctuations, an impact of the dog clutch caused during a shift operation, and a sound of the impact.

Japan Laid-open Patent Application Publication No. 2011-178228 discloses a marine propulsion device in which a spacer, by which a damper is positioned in place with respect to a propeller shaft in a thrust direction, and a propeller, are in contact with each other. Because of this, when a thrust is generated in a forward moving direction by rotation of the propeller, the propeller is pressed onto the spacer such that a friction force therebetween is increased in magnitude. Torque transmission to the propeller by the friction force is not made through the damper such that an attenuation effect exerted by the damper is degraded.

SUMMARY OF THE INVENTION

Preferred embodiments of the present invention inhibit power from being transmitted from a propeller shaft to a propeller in a path without being through a damper in a marine propulsion device.

A marine propulsion device according to a first preferred embodiment of the present disclosure includes a propeller, a propeller shaft, a bushing, a damper, and a spacer. The propeller shaft supports the propeller. The bushing is between the propeller and the propeller shaft and is unitarily rotated with the propeller shaft. The damper is fixed to the bushing and transmits rotation of the propeller shaft to the propeller. The spacer is spaced apart from the propeller in a back-and-forth direction in front of the bushing and positions the bushing in place with respect to the propeller shaft.

A propeller unit according to a second preferred embodiment of the present disclosure is mounted to a propeller shaft of a marine propulsion device. The propeller unit includes a propeller and a spacer. The propeller is supported by the propeller shaft and receives rotation of the propeller shaft transmitted thereto through a damper. The spacer is provided on the propeller shaft in front of the propeller and is separated from the propeller in a back-and-forth direction.

A method according to a third preferred embodiment of the present disclosure relates to a method of assembling a propeller unit to a propeller shaft of a marine propulsion device. The propeller unit includes a propeller, a bushing, a damper, and a spacer. The bushing is unitarily rotated with the propeller shaft. The damper is fixed to the bushing and transmits rotation of the propeller shaft to the propeller. The spacer positions the bushing in place with respect to the propeller shaft. The method includes fitting the spacer on the propeller shaft and fixing the bushing to the propeller shaft with a gap between the spacer and the propeller in a back-and-forth direction after the spacer is fitted on the propeller shaft.

In a marine propulsion device according to a preferred embodiment of the present invention, the spacer provides a gap with respect to the propeller in the back-and-forth direction. Because of this, when a thrust is generated in a forward moving direction by rotation of the propeller, friction is inhibited between the propeller and the spacer. Accordingly, a torque transmitted to the propeller through a friction force generated between the propeller and the spacer is inhibited, so that power is inhibited from being transmitted to the propeller in a path without being through the damper. As a result, an attenuating effect exerted by the damper is obtained such that it is made possible to inhibit, for instance, noises produced by repetitive collisions between gears in a dog clutch due to torque fluctuations of an engine and an impact sound produced by the dog clutch in shift operation.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
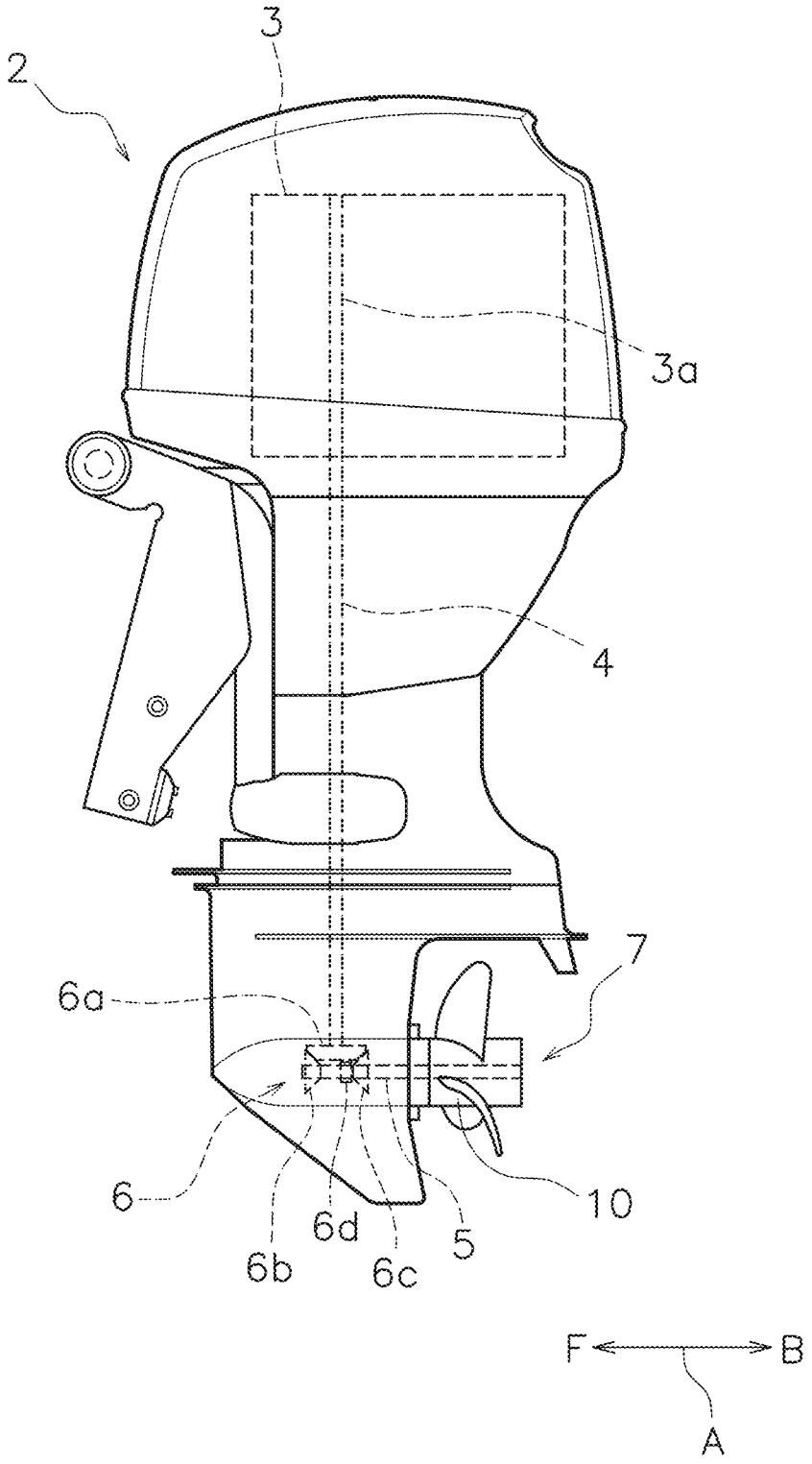
FIG. 1 is a side view of an outboard motor.

Preferred embodiments of the present invention will be hereinafter explained with reference to the drawings. FIG. 1 is a side view of an outboard motor 2 according to a first preferred embodiment. The outboard motor 2 is an exemplary marine propulsion device. The outboard motor 2 is attached to the stern of a watercraft (not shown in the drawings). The outboard motor 2 generates a thrust to propel the watercraft.

The outboard motor 2 includes a drive source 3, a driveshaft 4, a propeller shaft 5, a shift mechanism 6, and a propeller unit 7.

The drive source 3 generates a rotational force or rotational torque to rotate the propeller shaft 5. The drive source 3 is, for instance, an engine. The drive source 3 includes a crankshaft 3*a*. The crankshaft 3*a* extends in a vertical direction.

The driveshaft 4 is rotated by driving of the drive source 3. The driveshaft 4 extends in the vertical direction. The driveshaft 4 is connected to the crankshaft 3*a*.

The propeller shaft 5 supports a propeller 10 (to be described below). An axial direction A of the propeller shaft 5 corresponds to a back-and-forth direction of the outboard motor 2. In other words, the propeller shaft 5 extends in the back-and-forth direction of the outboard motor 2. It should be noted that in the following explanation, the axial direction A of the propeller shaft 5 will be referred to as "axial direction", whereas a perpendicular direction to the axial direction A will be referred to as "radial direction". On the other hand, one directional side indicated by arrow F will be referred to as "forward", whereas the other directional side indicated by arrow B will be referred to as "backward".

Figure 2:
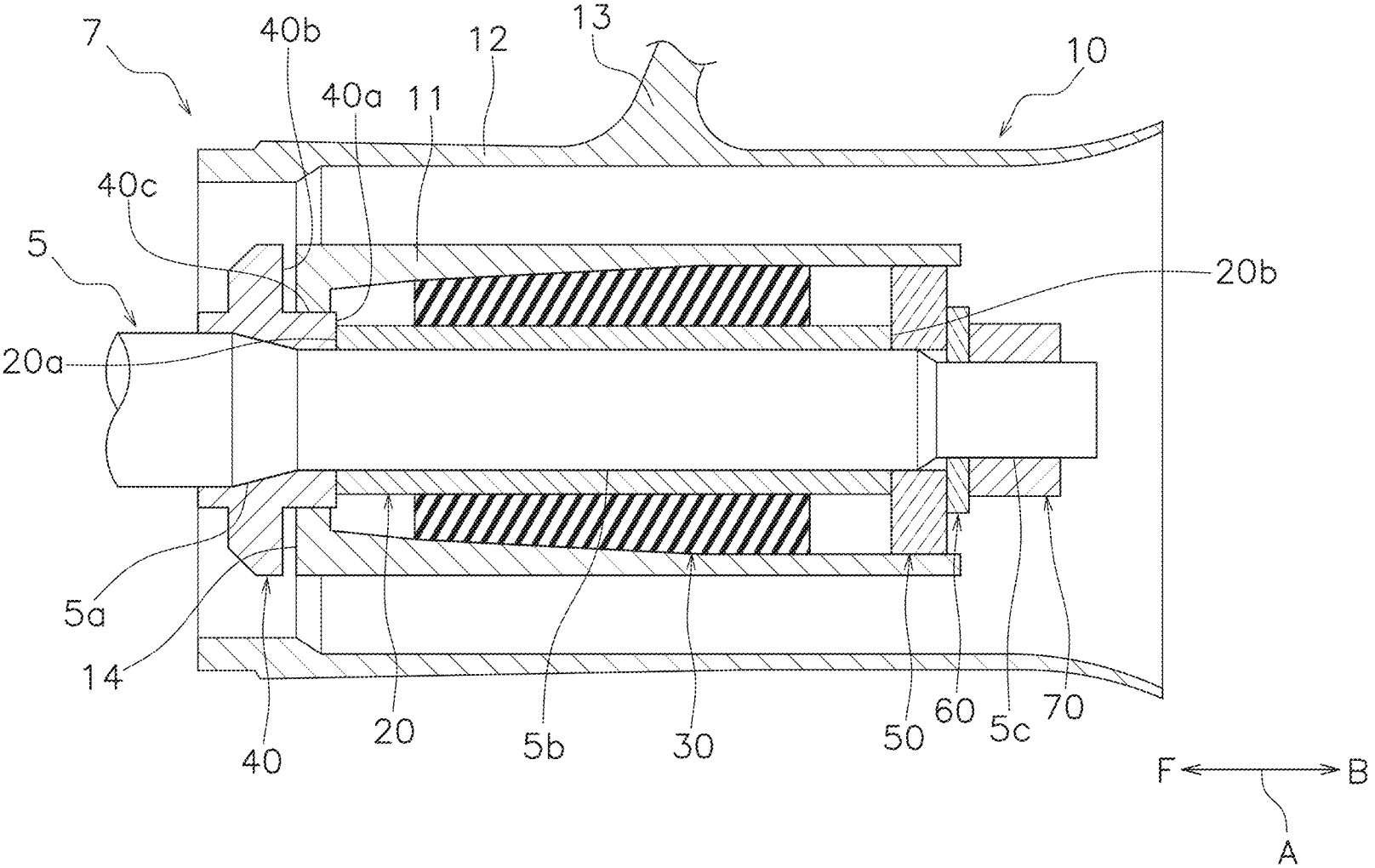
FIG. 2 is a schematic cross-sectional view of a propeller unit.

FIG. 2 is a schematic cross-sectional view of the propeller unit 7. In more detail, FIG. 2 is a schematic cross-sectional view of the propeller unit 7 in a condition that the rotational force or torque is not being transmitted to the propeller shaft 5 from the drive source 3.

As shown in FIG. 2, the propeller shaft 5 includes a taper portion 5*a*, a spline portion 5*b*, and a male threaded portion 5*c*. The taper portion 5*a* is shaped to taper backward. The spline portion 5*b* is disposed behind the taper portion 5*a*. The male threaded portion 5*c* is disposed behind the spline portion 5*b*.

The shift mechanism 6 connects or disconnects the driveshaft 4 and the propeller shaft 5 to or from each other. The shift mechanism 6 switches a rotational direction of the propeller shaft 5.

As shown in FIG. 1, the shift mechanism 6 includes a drive gear 6*a*, a forward moving gear 6*b*, a backward moving gear 6*c*, and a dog clutch 6*d*. The drive gear 6*a* is unitarily rotated with the driveshaft 4. The forward moving gear 6*b* and the backward moving gear 6*c* are meshed with the drive gear 6*a*. Rotation of the driveshaft 4 is transmitted to the forward/backward moving gear 6*b*, 6*c* through the drive gear 6*a*.

The dog clutch 6*d* is movable to a forward moving position, a neutral position, and a backward moving position. When the dog clutch 6*d* is in the forward moving position, the forward moving gear 6*b* is connected to the propeller shaft 5 such that the rotation of the driveshaft 4 is transmitted to the propeller shaft 5 through the forward moving gear 6*b*. When the dog clutch 6*d* is in the neutral position, the propeller shaft 5 is disconnected from both the forward moving gear 6*b* and the backward moving gear 6*c* such that the rotation of the driveshaft 4 is not transmitted to the propeller shaft 5. When the dog clutch 6*d* is in the backward moving position, the backward moving gear 6*c* is connected to the propeller shaft 5 such that the rotation of the driveshaft 4 is transmitted to the propeller shaft 5 through the backward moving gear 6*c*.

As shown in FIG. 2, the propeller unit 7 is mounted to the propeller shaft 5. The propeller unit 7 includes the propeller 10, a bushing 20, a damper 30, a first spacer 40, a second spacer 50, a washer 60, and a nut 70.

The propeller 10 receives rotation of the propeller shaft 5 transmitted thereto through the damper 30. When a thrust is generated by forward rotation (forward moving directional rotation) of the propeller 10, the propeller 10 is moved in an approaching direction to the first spacer 40 by elastic deformation of the damper 30.

The propeller 10 includes an inner tubular portion 11, an outer tubular portion 12, a plurality of blades 13, and a plurality of ribs (not shown in the drawings).

Each of the inner tubular portion 11 and the outer tubular portion 12 has a tubular shape and extends in the axial direction. The inner tubular portion 11 is disposed inside the outer tubular portion 12. The spline portion 5*b* of the propeller shaft 5 is disposed inside the inner tubular portion 11. The inner tubular portion 11 is disposed behind the first spacer 40 so as to be spaced apart therefrom in the back-and-forth direction. A gap of approximately 2 mm, for example, is provided between the inner tubular portion 11 and the first spacer 40 in the back-and-forth direction. The gap between the inner tubular portion 11 and the first spacer 40 in the back-and-forth direction preferably has a distance of at least 1 mm or greater and more preferably has a distance of 1.5 mm or greater, for example. When a thrust is generated by the forward rotation of the propeller 10, the inner tubular portion 11 is moved in the approaching direction to the first spacer 40 (i.e., forward) by the elastic deformation of the damper 30.

The outer tubular portion 12 covers the inner tubular portion 11 from the radial direction. The plurality of blades 13 radially extend from the outer peripheral surface of the outer tubular portion 12. The plurality of ribs radially extend to connect the inner tubular portion 11 and the outer tubular portion 12 therethrough. The plurality of ribs are connected to the outer peripheral surface of the inner tubular portion 11 and the inner peripheral surface of the outer tubular portion 12.

The bushing 20 has a tubular shape and extends in the axial direction. The bushing 20 is disposed radially between the inner tubular portion 11 and the propeller shaft 5. The bushing 20 is fixed to the propeller shaft 5 and is unitarily rotated therewith. The inner peripheral surface of the bushing 20 is spline-coupled to the spline portion 5*b* of the propeller shaft 5.

The bushing 20 is disposed axially between the first spacer 40 and the second spacer 50. The bushing 20 includes a front end 20*a* to be brought into contact with the first spacer 40 and a rear end 20*b* to be brought into contact with the second spacer 50. The bushing 20 is prevented from axially moving by the taper portion 5*a*, the first spacer 40, the second spacer 50, the washer 60, and the nut 70.

The damper 30 transmits the rotation of the propeller shaft 5 to the propeller 10, and simultaneously, inhibits an impact from being transmitted to the propeller 10 from the propeller shaft 5. The damper 30 absorbs a torque acting in the rotational direction of the propeller shaft 5 and this inhibits noises produced by repetitive collisions between the gears in the shift mechanism 6 due to torque fluctuations of the drive source 3 and an impact sound produced by the dog clutch 6*d* during a shift operation. The noises, produced by repetitive collisions between the gears in the shift mechanism 6 due to torque fluctuations of the drive source 3, is likely to be produced when the rotational speed of the drive source 3 falls in a low-speed range (of, e.g., about 1500 rpm or less). It should be noted that the noises, produced by repetitive collisions between the gears in the shift mechanism 6 due to torque fluctuations of the drive source 3, will be hereinafter simply referred to as "rattle sound" on an as-needed basis.

An elastic member having elastically deformable characteristics is provided as the damper 30. The damper 30 is made of, for instance, rubber and has a tubular shape. The damper 30 extends in the axial direction. The damper 30 is fixed to the outer peripheral surface of the bushing 20 and is unitarily rotated with the propeller shaft 5 together with the bushing 20. The inner peripheral surface of the damper 30 is fixed to the outer peripheral surface of the bushing 20 such that the damper 30 is immovable with respect to the bushing 20. The damper 30 is disposed inside the inner tubular portion 11 and is fixed thereto by press-fitting, for example. The outer peripheral surface of the damper 30 is spline-coupled to the inner peripheral surface of the inner tubular portion 11. Accordingly, the rotation of the propeller shaft 5 is transmitted to the propeller 10 through the bushing 20 and the damper 30.

The first spacer 40 is an exemplary spacer. The first spacer 40 has a tubular shape. The first spacer 40 is disposed inside the outer tubular portion 12. The first spacer 40 is mounted to the taper portion 5*a* of the propeller shaft 5. The inner peripheral surface of the first spacer 40 is in contact with the taper portion 5*a* of the propeller shaft 5. The first spacer 40 is prevented from moving forward by the taper portion 5*a*.

The first spacer 40 is disposed in front of the bushing 20 on the propeller shaft 5, while being spaced apart from the inner tubular portion 11 of the propeller 10 in the back-and-forth direction. The first spacer 40 is spaced apart from the inner tubular portion 11 of the propeller 10 in the back-and-forth direction, while in contact with the bushing 20. The first spacer 40 positions the bushing 20 in place with respect to the propeller shaft 5. The first spacer 40 prevents the bushing 20 from moving forward.

The first spacer 40 includes a positioning portion 40*a*, a restriction portion 40*b*, and a support portion 40*c*. The positioning portion 40*a* radially extends. The positioning portion 40*a* is disposed opposite to the front end 20*a* of the bushing 20 in the back-and-forth direction. A rear end surface of the first spacer 40 is provided as the positioning portion 40*a*. The positioning portion 40*a* is in contact with the front end 20*a* of the bushing 20 so as to position the bushing 20 in place with respect to the propeller shaft 5.

The restriction portion 40*b* is disposed on a more front side than the positioning portion 40*a*. The restriction portion 40*b* extends radially. The restriction portion 40*b* is disposed radially on an outer side than the positioning portion 40*a*. The restriction portion 40*b* is opposed to the inner tubular portion 11 in the back-and-forth direction. The restriction portion 40*b* is disposed in front of the inner tubular portion 11 so as to be spaced apart therefrom in the back-and-forth direction.

The support portion 40*c* is disposed between the positioning portion 40*a* and the restriction portion 40*b*. The support portion 40*c* extends in the axial direction. The support portion 40*c* is disposed in contact with the inner peripheral surface of a portion adjacent to the front end in the inner tubular portion 11 and radially supports the inner tubular portion 11.

The second spacer 50 has a tubular shape. The second spacer 50 is disposed axially between the bushing 20 and the washer 60. The second spacer 50 is mounted to the outer peripheral surface of the propeller shaft 5. The front surface of the second spacer 50 is in contact with the rear end 20*b* of the bushing 20. The rear surface of the second spacer 50 is in contact with the washer 60.

The washer 60 is disposed axially between the second spacer 50 and the nut 70. The washer 60 is mounted to the male threaded portion 5*c* of the propeller shaft 5. The rear surface of the washer 60 is in contact with the nut 70.

The nut 70 is fastened to the male threaded portion 5*c* of the propeller shaft 5. The bushing 20, the second spacer 50, and the washer 60 are interposed between, and held by, the nut 70 and the first spacer 40.

Figure 3:
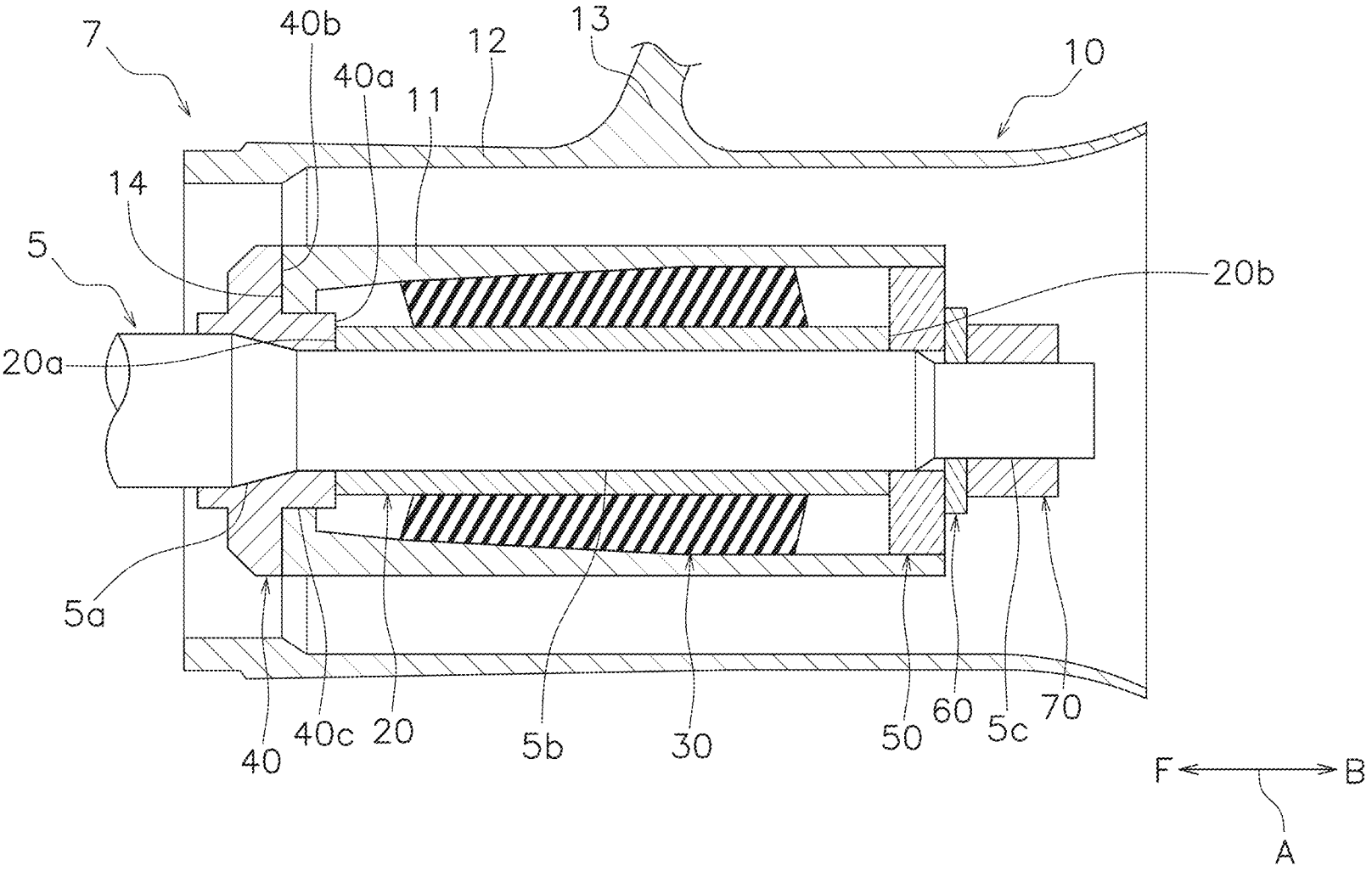
FIG. 3 is a schematic cross-sectional view of the propeller unit.

FIG. 3 is a schematic cross-sectional view of the propeller unit 7 in a condition that the damper 30 is elastically deformed. In more detail, FIG. 3 is a schematic cross-sectional view of the propeller unit 7 in a condition that the damper 30 is elastically deformed when a load greater than a predetermined load acts on the damper 30 by a thrust generated in the forward rotation (forward moving directional rotation) of the propeller 10.

The propeller 10 is movable from an initial position shown in FIG. 2 to a contact position shown in FIG. 3 in accordance with elastic deformation of the damper 30. As shown in FIG. 3, the propeller 10 includes a contact portion 14. The contact portion 14 is disposed on the inner tubular portion 11. The front-end surface of the inner tubular portion 11 is provided as the contact portion 14. The contact portion 14 radially overlaps with the support portion 40*c* of the first spacer 40. The contact portion 14 is opposed to the restriction portion 40*b* of the first spacer 40 in the back-and-forth direction. The contact portion 14 is disposed on a more front side than the front end 20*a* of the bushing 20. The contact portion 14 is brought into contact with the restriction portion 40*b* in accordance with the elastic deformation of the damper 30. A load, greater than a load tolerable by the damper 30, is inhibited from acting on the damper 30 by the contact portion 14.

When a load greater than a predetermined load acts on the damper 30 in a condition that a thrust is being generated in the forward rotation of the propeller 10 (hereinafter simply referred to as "forward moving condition"), the damper 30 is elastically deformed such that the contact portion 14 is brought into contact with the restriction portion 40*b* of the first spacer 40 in the back-and-forth direction. The contact portion 14 is not kept in contact with the restriction portion 40*b* unless a load greater than the predetermined load acts on the damper 30 in the forward moving condition. In other words, the inner tubular portion 11 is kept spaced apart from the first spacer 40 in the back-and-forth direction unless a load greater than the predetermined load acts on the damper 30 in the forward moving condition.

The predetermined load is set to be less than or equal to a limit load of the damper 30. The limit load has a magnitude not enough to damage or break the damper 30. Also, the magnitude of the limit load is not enough to impair the innate function of the damper 30. For example, it is preferable that the magnitude of the limit load is not enough to cause plastic deformation of the damper 30.

It should be noted that the contact portion 14 may be configured to be brought into contact with the restriction portion 40*b* of the first spacer 40 in the back-and-forth direction by the elastic deformation of the damper 30 caused when a drive force, transmitted from the drive source 3 to the propeller shaft 5, becomes greater than a predetermined drive force in the forward moving condition. In this case, the predetermined drive force is set to be less than or equal to the limit load of the damper 30. Alternatively, the contact portion 14 may be configured to be brought into contact with the restriction portion 40*b* of the first spacer 40 in the back-and-forth direction by the elastic deformation of the damper 30 caused when the rotational speed of the drive source 3 becomes greater than a predetermined rotational speed in the forward moving condition. In this case, the predetermined rotational speed is set to be less than or equal to a rotational speed corresponding to the limit load of the damper 30. For example, the predetermined rotational speed is set to be less than or equal to about 2000 rpm. Besides, the predetermined rotational speed is preferably set to be greater than about 1000 rpm and is more preferably set to be greater than about 1500 rpm, for example.

Specifically, the predetermined rotational speed is preferably set to be greater than about 1500 rpm if rattle sounds are produced in the outboard motor 2 when the rotational speed of the drive source 3 is about 1500 rpm or less. Alternatively, the predetermined rotational speed is preferably set to be greater than about 1200 rpm if rattle sounds are produced in the outboard motor 2 when the rotational speed of the drive source 3 falls in a range of about 400 to about 1200 rpm, for example. Yet alternatively, the predetermined rotational speed is preferably set to be greater than about 1000 rpm if rattle sounds are produced in the outboard motor 2 when the rotational speed of the drive source 3 falls in a range of about 400 to about 1000 rpm, for example. It should be noted that, from the perspective of inhibiting transmission of a rotational force or torque from the drive source 3 to the propeller 10 in a path without being through the damper 30, the predetermined rotational speed is preferably set to be more approximate to the rotational speed corresponding to the limit load of the damper 30 than to the maximum rotational speed in the rotational speed range in which rattle sounds are produced. For example, the predetermined rotational speed is preferably set to be greater than about 1800 rpm when the rotational speed corresponding to the limit load of the damper 30 is about 2100 rpm and the maximum rotational speed of the drive source 3 is about 1500 rpm in the rotational speed range in which rattle sounds are produced.

Figure 4:
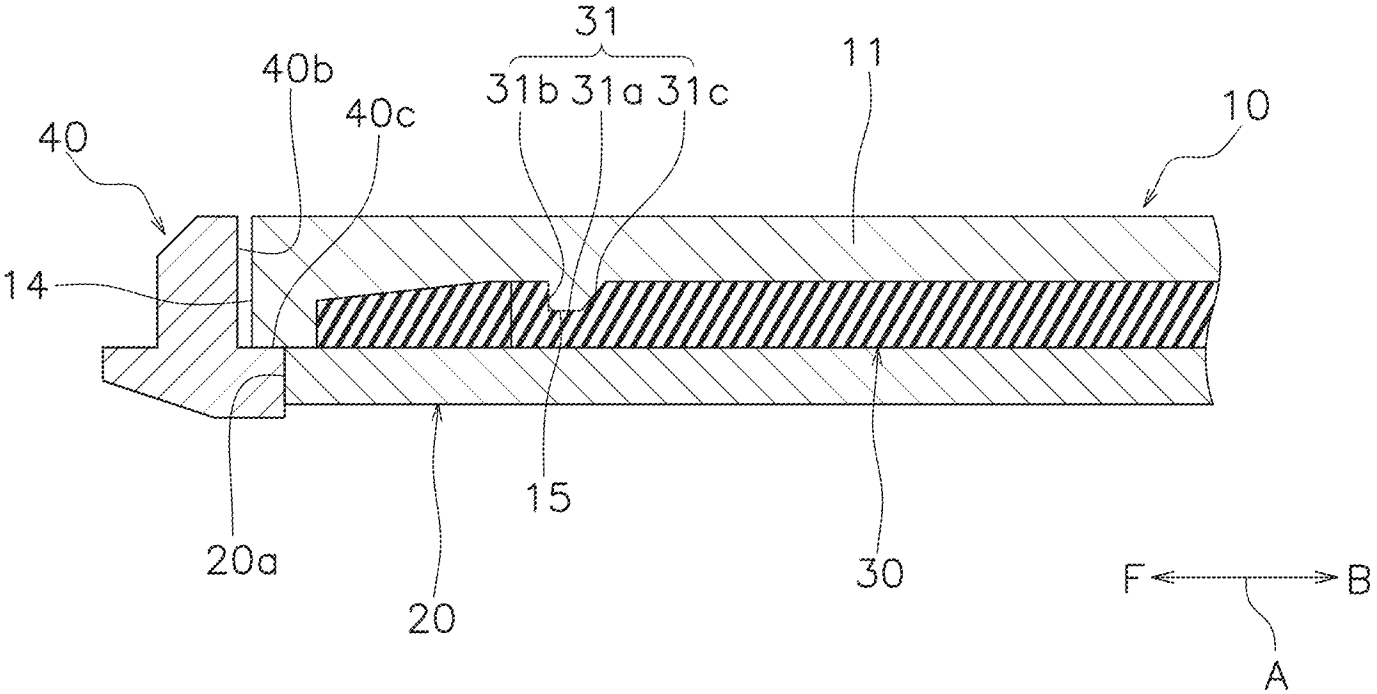
FIG. 4 is a diagram for explaining positioning of a propeller with respect to a damper.

FIG. 4 is a diagram for explaining positioning of the propeller 10 with respect to the damper 30. The damper 30 includes a recess 31 on the outer peripheral surface thereof so as to position the propeller 10 in place in the back-and-forth direction. The propeller 10 includes a protrusion 15 to be locked to the recess 31.

The recess 31 is recessed in a direction from the outer peripheral surface of the damper 30 toward the inner peripheral surface of the damper 30. The recess 31 includes a bottom 31*a*, a first inner wall 31*b*, and a second inner wall 31*c*. The bottom 31*a* extends in the axial direction. As shown in FIG. 4, the first inner wall 31*b* radially extends toward the inner tubular portion 11 from the front end of the bottom 31*a* in the cross-sectional view. The first inner wall 31*b* locks the protrusion 15 such that the propeller 10 is prevented from sliding forward with respect to the damper 30. Because of this, it is easy to keep constant the gap between the contact portion 14 and the restriction portion 40*b* of the first spacer 40 in the back-and-forth direction.

As shown in FIG. 4, the second inner wall 31*c* is shaped such that an angle defined between the bottom 31*a* and the second inner wall 31*c* is obtuse in the cross-sectional view. The second inner wall 31*c* radially extends backward and toward the inner tubular portion 11 from the rear end of the bottom 31*a* in the cross-sectional view.

The protrusion 15 is provided on the inner peripheral surface of the inner tubular portion 11. The protrusion 15 is shaped to protrude in a direction from the outer peripheral surface of the inner tubular portion 11 toward the inner peripheral surface of the inner tubular portion 11. The protrusion 15 is shaped to be fitted to the recess 31. Because of the configuration, when the damper 30 is press-fitted to the inner tubular portion 11, it is easy for the first inner wall 31*b* to move over the protrusion 15.

In the outboard motor 2 described above, the first spacer 40 has a gap with respect to the propeller 10 in the back-and-forth direction. Because of this, when a thrust is generated in the forward moving direction by rotation of the propeller 10, friction is inhibited from being caused between the propeller 10 and the first spacer 40. Accordingly, a torque transmitted to the propeller 10 through a friction force generated between the propeller 10 and the first spacer 40 is inhibited, so that a rotational force outputted from the drive source 3 is inhibited from being transmitted to the propeller 10 in a path without being through the damper 30. As a result, an attenuating effect exerted by the damper 30 is obtained such that it is made possible to inhibit noises produced by repetitive collisions between the gears in the dog clutch 6*d* due to torque fluctuations of the drive source 3 and an impact sound produced by the dog clutch 6*d* during a shift operation.

Figure 5:
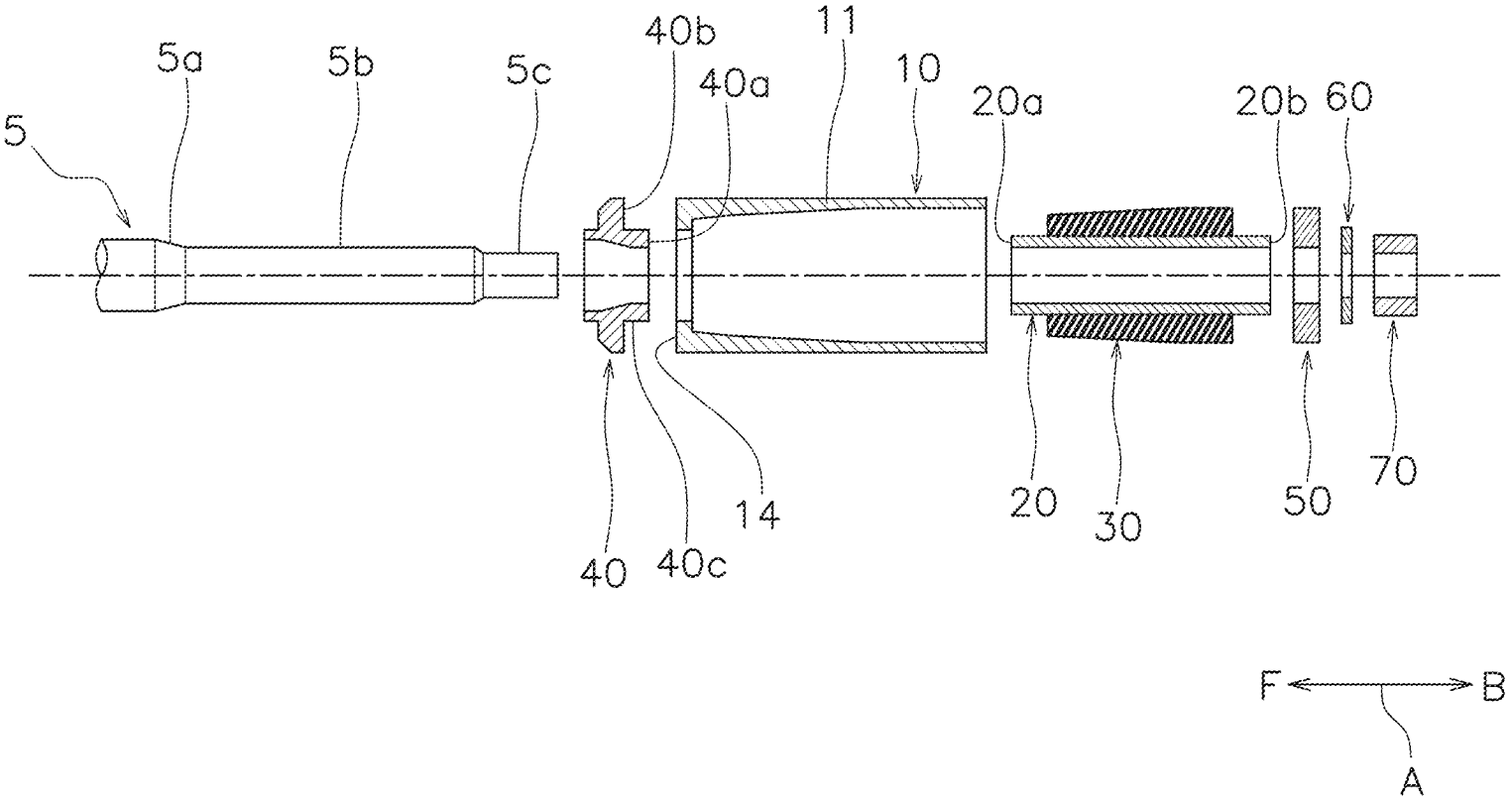
FIG. 5 is an exploded schematic cross-sectional view of the propeller unit.

Next, a series of steps of assembling the propeller unit 7 to the propeller shaft 5 in the outboard motor 2 will be explained. FIG. 5 is an exploded schematic cross-sectional view of the propeller unit 7. It should be noted that FIG. 5 omits illustration of the outer tubular portion 12 of the propeller 10.

As shown in FIG. 5, the components of the propeller 10, the bushing 20 including the damper 30 fixed thereto, the first spacer 40, the second spacer 50, the washer 60, and the nut 70 are provided. The first spacer 40 is fitted on the propeller shaft 5. After the first spacer 40 is fitted to the propeller shaft 5, the bushing 20 is fixed to the propeller shaft 5 with a gap between the first spacer 40 and the propeller 10 in the back-and-forth direction.

More specifically, the bushing 20, including the damper 30 fixed thereto, is fixed to the inner tubular portion 11 of the propeller 10 by press-fitting, for example. The damper 30 positions the propeller 10 in place in the back-and-forth direction by locking the protrusion 15 to the recess 31. It should be noted that the damper 30 may have been preliminarily fixed to the inner tubular portion 11 of the propeller 10 by press-fitting.

The bushing 20, the second spacer 50, and the washer 60 are fitted to the propeller shaft 5, then, the bushing 20 is fixed to the propeller shaft 5 by screwing the nut 70 onto the male threaded portion 5*c* until the front end 20*a* of the bushing 20 is contacted with the positioning portion 40*a* of the first spacer 40. Here, the axial distance between the restriction portion 40*b* and the positioning portion 40*a* in the first spacer 40 is set to be longer than that between the contact portion 14 of the propeller 10 and the front end 20*a* of the bushing 20. Because of this, when the bushing 20 is fixed to the propeller shaft 5, the contact portion 14 of the propeller 10 is spaced apart from the restriction portion 40*b* of the first spacer 40 in the back-and-forth direction as shown in FIG. 2. It should be noted that a washer 42 (to be described below) may be provided to space the contact portion 14 of the propeller 10 apart from the restriction portion 40*b* of the first spacer 40 in the back-and-forth direction.

Preferred embodiments of the present invention have been explained above. However, the present invention is not limited to the preferred embodiments described above, and a variety of changes can be made without departing from the gist of the present invention.

Figure 6:
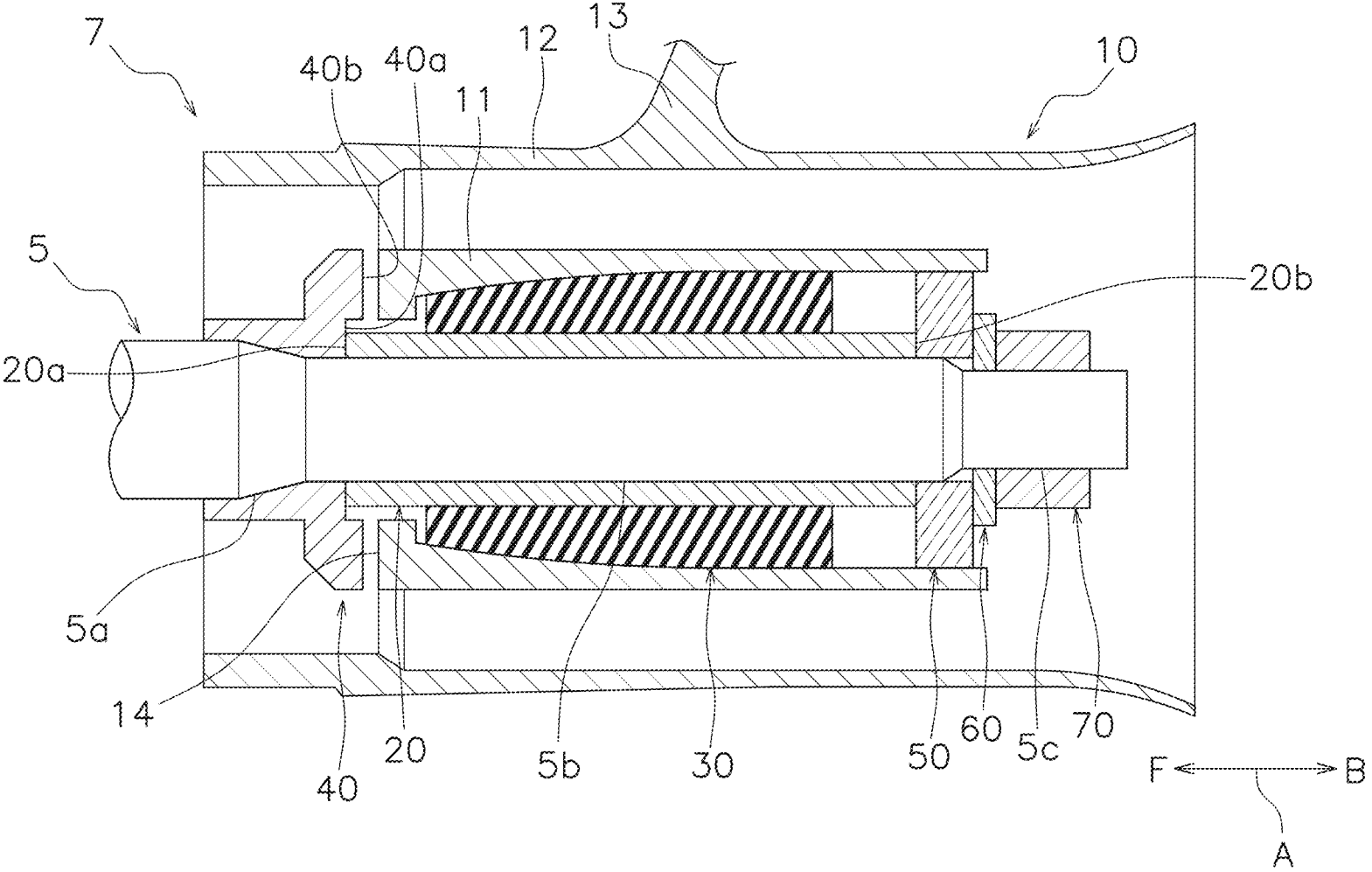
FIG. 6 is a diagram for explaining a first modification of a spacer.

FIG. 6 is a diagram for explaining a first modification of the first spacer 40. In the first modification of the first spacer 40, the restriction portion 40*b* is disposed on a more rear side than the positioning portion 40*a* and does not radially overlap with the contact portion 14. The support portion 40*c* is omitted in the first modification. In this case, the contact portion 14 of the propeller 10 is disposed on a more rear side than the front end 20*a* of the bushing 20. Besides, the axial distance between the restriction portion 40*b* and the positioning portion 40*a* in the first spacer 40 is set to be shorter than that between the contact portion 14 of the propeller 10 and the front end 20*a* of the bushing 20.

Figure 7:
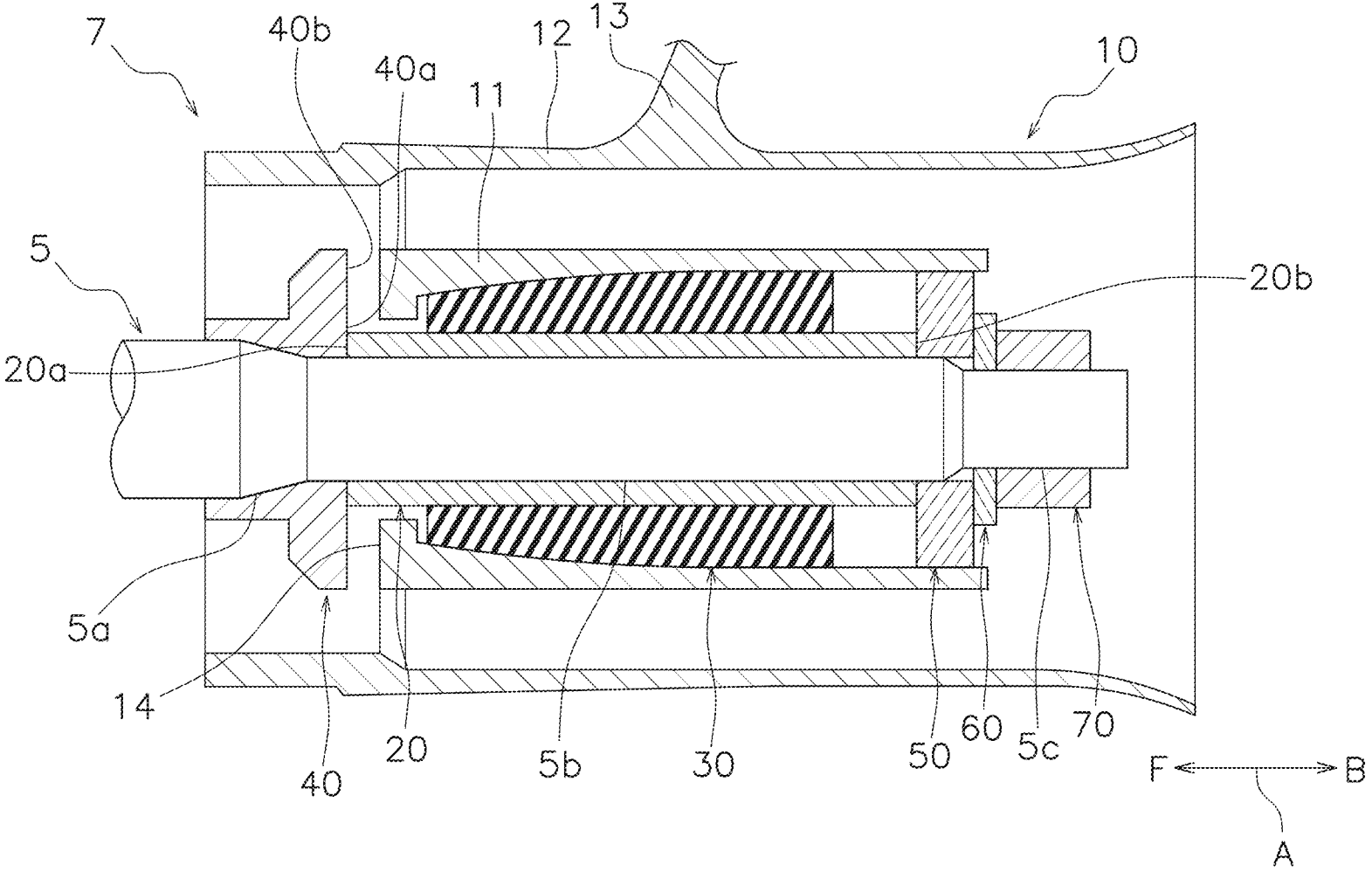
FIG. 7 is a diagram for explaining a second modification of the spacer.

FIG. 7 is a diagram for explaining a second modification of the first spacer 40. In the second modification of the first spacer 40, the positioning portion 40*a* and the restriction portion 40*b* radially overlap with each other and do not radially overlap with the contact portion 14. In other words, the restriction portion 40*b* is flush with the positioning portion 40*a*. The support portion 40*c* is omitted in the second modification. In this case, the contact portion 14 of the propeller 10 is disposed on a more rear side than the front end 20*a* of the bushing 20.

Figure 8:
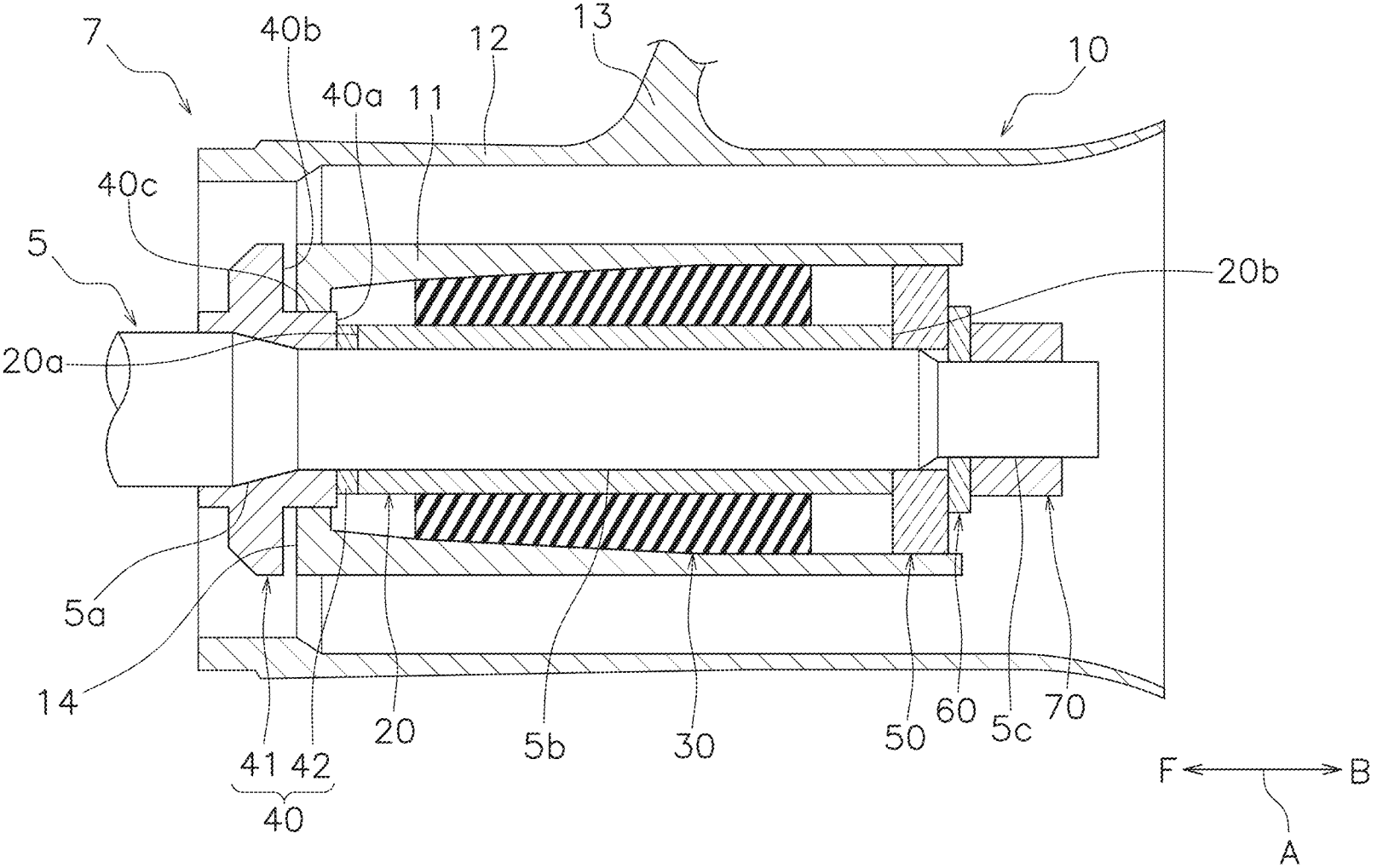
FIG. 8 is a diagram for explaining a third modification of the spacer.

FIG. 8 is a diagram for explaining a third modification of the first spacer 40. In the third modification, the first spacer 40 includes a spacer body 41 and the washer 42. The spacer body 41 includes the positioning portion 40*a*, the restriction portion 40*b*, and the support portion 40*c*. The washer 42 is disposed axially between the spacer body 41 and the bushing 20. The washer 42 adjusts a gap between the restriction portion 40*b* of the spacer body 41 and the contact portion 14 of the propeller 10 in the back-and-forth direction. In this case, for instance, when the washer 42 is disposed between the spacer body 41 and the bushing 20 in an existing marine propulsion device, the propeller 10 is spaced apart from the spacer body 41 in the back-and-forth direction.

Figure 9:
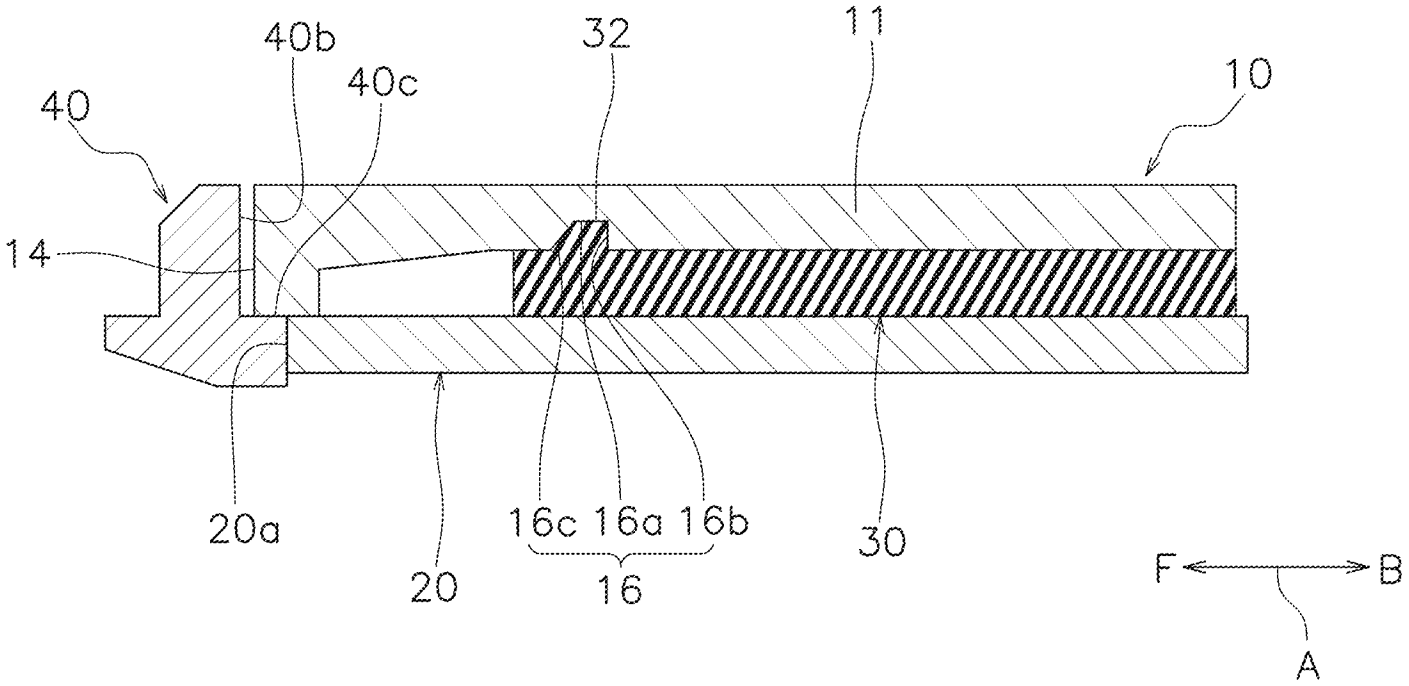
FIG. 9 is a diagram for explaining a modification of the propeller and the damper.

FIG. 9 is a diagram for explaining a modification of the propeller 10 and the damper 30. In this modification, the damper 30 includes a protrusion 32 on the outer peripheral surface thereof to position the propeller 10 in place in the back-and-forth direction. In this modification, the propeller 10 includes a recess 16 to which the protrusion 32 is locked.

The recess 16 is provided on the inner peripheral surface of the inner tubular portion 11. The recess 16 is recessed in a direction from the inner peripheral surface of the inner tubular portion 11 toward the outer peripheral surface of the inner tubular portion 11. The recess 16 includes a bottom 16*a*, a first inner wall 16*b*, and a second inner wall 16*c*. The bottom 16*a* extends in the axial direction. The first inner wall 16*b* radially extends toward the bushing 20 from the rear end of the bottom 16*a* in the cross-sectional view. The second inner wall 16*c* is shaped such that an angle defined between the bottom 16*a* and the second inner wall 16*c* is obtuse in the cross-sectional view. The second inner wall 16*c* radially extends forward and toward the bushing 20 from the front end of the bottom 16*a* in the cross-sectional view.

The protrusion 32 is provided on the outer peripheral surface of the damper 30. The protrusion 32 is shaped to protrude in a direction from the inner peripheral surface of the damper 30 toward the outer peripheral surface of the damper 30. The protrusion 32 is shaped to be fitted to the recess 16.

In the preferred embodiments described above, the outboard motor 2 has been explained as an exemplary marine propulsion device. However, the present invention may be applied to another type of marine propulsion device such as an inboard engine outboard drive.

The drive source 3 may be an electric motor. Alternatively, the drive source 3 may be a hybrid system including an engine and an electric motor.

In the propeller unit 7, the bushing 20, the damper 30, or the second spacer 50 may have a function of inhibiting or preventing the propeller 10 from sliding backward with respect to the damper 30. For example, the second spacer 50 may be configured to be meshed with one or more cutouts (not shown in the drawings) provided on the rear end surface of the inner tubular portion 11.

The recess 31 may be one of a plurality of recesses 31 disposed at intervals in the rotational direction of the propeller shaft 5. The protrusion 15 may be one of a plurality of protrusions 15 disposed at intervals in the rotational direction of the propeller shaft 5. The recess 16 may be one of a plurality of recesses 16 disposed at intervals in the rotational direction of the propeller shaft 5. The protrusion 32 may be one of a plurality of protrusions 32 disposed at intervals in the rotational direction of the propeller shaft 5.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion device comprising:

a propeller including an inner tubular portion, an outer tubular portion outside the inner tubular portion, and a plurality of blades on an outer peripheral surface of the outer tubular portion;

a propeller shaft to support the propeller, the propeller shaft extending in a back-and-forth direction from a front end connected to a shift mechanism to a rear end connected to the propeller;

a bushing between the inner tubular portion of the propeller and the propeller shaft and unitarily rotatable with the propeller shaft;

a damper fixed to the bushing to transmit rotation of the propeller shaft to the propeller; and a spacer spaced apart from the inner tubular portion of the propeller in the back-and-forth direction and in front of the bushing in the back-and-forth direction to position the bushing in place with respect to the propeller shaft.

2. The marine propulsion device according to claim 1, wherein the spacer is spaced apart from the propeller in the back-and-forth direction and in contact with the bushing.

3. The marine propulsion device according to claim 1, wherein the propeller is operable to move in an approaching direction to the spacer by elastic deformation of the damper caused when a thrust is generated by forward rotation of the propeller.

4. The marine propulsion device according to claim 1, wherein the propeller includes a contact portion movable to contact with the spacer in the back-and-forth direction by elastic deformation of the damper caused when a load greater than a predetermined load acts on the damper in a condition that a thrust is generated by forward rotation of the propeller.

5. The marine propulsion device according to claim 4, wherein the predetermined load is less than or equal to a limit load of the damper.

6. The marine propulsion device according to claim 1, further comprising:

a drive source to generate a rotational force or rotational torque to rotate the propeller shaft; wherein the propeller includes a contact portion movable to contact with the spacer in the back-and-forth direction by elastic deformation of the damper caused when a rotational speed of the drive source becomes greater than a predetermined rotational speed in a condition that a thrust is generated by forward rotation of the propeller.

7. The marine propulsion device according to claim 6, wherein the predetermined rotational speed is less than or equal to 2000 rpm.

8. A marine propulsion device comprising:

a propeller;

a propeller shaft to support the propeller, the propeller shaft extending in a back-and-forth direction from a front end connected to a shift mechanism to a rear end connected to the propeller;

a bushing between the propeller and the propeller shaft and unitarily rotatable with the propeller shaft;

a damper fixed to the bushing to transmit rotation of the propeller shaft to the propeller; and a spacer spaced apart from the propeller in the back-and-forth direction and in front of the bushing in the back-and-forth direction to position the bushing in place with respect to the propeller shaft; wherein the propeller includes a contact portion movable to contact with the spacer in the back-and-forth direction by elastic deformation of the damper caused when a load greater than a predetermined load acts on the damper in a condition that a thrust is generated by forward rotation of the propeller; and the contact portion of the propeller does not overlap with the spacer in a radial direction of the propeller shaft.

9. The marine propulsion device according to claim 1, wherein the spacer includes a spacer body and a washer between the spacer body and the bushing.

10. The marine propulsion device according to claim 1, wherein the damper has an outer peripheral surface including a recess to position the propeller in place in the back-and-forth direction; and the propeller includes a protrusion to be locked to the recess.

11. The marine propulsion device according to claim 1, wherein the damper has an outer peripheral surface including a protrusion to position the propeller in place in the back-and-forth direction; and the propeller includes a recess to which the protrusion is locked.

12. A propeller unit mounted to a propeller shaft of a marine propulsion device, the propeller unit comprising:

a propeller supported by the propeller shaft to receive rotation of the propeller shaft transmitted thereto through a damper, the propeller shaft extending in a back-and-forth direction from a front end connected to a shift mechanism to a rear end connected to the propeller, and the propeller including an inner tubular portion, an outer tubular portion outside the inner tubular portion, and a plurality of blades on an outer peripheral surface of the outer tubular portion; and a spacer provided on the propeller shaft in front of the propeller in the back-and-forth direction and separated from the inner tubular portion of the propeller in the back-and-forth direction.

13. A method of assembling a propeller unit to a propeller shaft of a marine propulsion device, the propeller unit including a propeller including an inner tubular portion, an outer tubular portion outside the inner tubular portion, and a plurality of blades on an outer peripheral surface of the outer tubular portion, a bushing unitarily rotatable with the propeller shaft, a damper fixed to the bushing to transmit rotation of the propeller shaft to the propeller, and a spacer to position the bushing in place with respect to the propeller shaft, the method comprising:

fitting the spacer on the propeller shaft; and fixing the bushing to the propeller shaft with a gap between the spacer and the inner tubular portion of the propeller in a back-and-forth direction after the spacer is fitted on the propeller shaft.

14. The method according to claim 13, wherein the spacer includes a spacer body and a washer between the spacer body and the bushing to adjust a gap between the spacer body and the inner tubular portion of the propeller in the back-and-forth direction.

* * * * *